US005511936A

United States Patent [19]

Goldkuhle

[11] Patent Number: 5,511,936

[45] Date of Patent: Apr. 30, 1996

[54] SEPARATION METHOD AND DEVICE

[75] Inventor: Gerhard Goldkuhle, Konstanz, Germany

[73] Assignee: Licentia Patent-Verwaltungs-GmbH, Frankfurt am Main, Germany

[21] Appl. No.: 224,745

[22] Filed: Apr. 7, 1994

[30] Foreign Application Priority Data

Apr. 7, 1993 [DE] Germany ..... 43 11 390.7
Apr. 22, 1993 [DE] Germany ..... 43 13 150.6

[51] Int. Cl.[6] ..... B65H 1/02

[52] U.S. Cl. ..... 414/797; 414/797.2; 414/797.3; 414/786

[58] Field of Search ..... 414/797, 797.2, 414/797.3, 786, 798.9; 271/11, 94

[56] References Cited

U.S. PATENT DOCUMENTS 3,391,926 7/1968 Jaatinen ..... 414/797.3 X
4,042,235 8/1977 Wanner et al. ..... 271/94
4,119,219 10/1978 Marschke ..... 414/797.3 X
4,903,047 2/1990 Hatanaka ..... 271/94 X
5,290,022 3/1994 Sabatier et al. ..... 271/94 X
5,295,675 3/1994 Hain et al. ..... 271/94 X
5,295,676 3/1994 Kenin et al. ..... 271/94
5,344,133 9/1994 Jantsch et al. ..... 271/94

FOREIGN PATENT DOCUMENTS 0142538 7/1988 European Pat. Off. .

*Primary Examiner*—David A. Bucci
*Attorney, Agent, or Firm*—Spencer & Frank

[57] ABSTRACT

Separating flat parcels from a stack of parcels is accomplished by moving a drawing element in a conveying direction so that a surface of the drawing element comes into contact with a first parcel of the stacked parcels. A stacking pressure is generating with a stack support element in a direction toward the surface of the drawing element so that a force is exerted on the first parcel in the direction of the drawing element and the surface of the drawing element is in close frictional contact with the first parcel. The force exerted on the first parcel in the direction of the surface of the drawing element is increased by generating a vacuum on a side of the drawing element. The first parcel is conveyed with the drawing element through a gap between the drawing element and a guide wall provided for front edges of the stacked parcels.

10 Claims, 3 Drawing Sheets

SEPARATION METHOD AND DEVICE

CROSS REFERENCE TO RELATED APPLICATION

This application claims the priority of German Applications Nos. P 43 13 150.6 filed April 22, 1993, and P 43 11 390.7 filed Apr. 7, 1993, both of which are incorporated herein by reference.

BACKGROUND OF THE INVENTION

1. Field of The Invention

The invention relates to the field of separation methods and devices for separating flat parcels, such as letters, documents and the like, from a stack, and in particular to an apparatus and method using a drawing element that travels in a conveying direction and acts by means of friction on a respective parcel to be drawn off.

2. Background Information

Separation methods and devices are known from, for example, European Patent EP 0,142,538. One known problem associated with separation methods and devices is the so-called double-drawing error. This error occurs when in addition to a desired first parcel to be drawn off of a stack, a further second parcel is drawn off. This problem may be due to the frictional force between the first parcel in the stack and the second parcel being too great, or because the second parcel protrudes and is drawn off too early due to an insufficiently uniform alignment of the front edges of the parcels.

A further problem lies in controlling a clearance gap between the drawn-off parcels, which is determined by the force exerted by the drawing element on the first parcel in the stack. Both of these problems, i.e., the double-drawing and clearance gap problems, are to a degree functions of parameters such as the parcel features, i.e., particularly weight, thickness, roughness and moisture content of the parcel material, as well as environmental conditions, in particular the amount of moisture in the ambient air.

A further problem associated with known separation methods is that a considerable amount of paper abrasion can be caused by the drawing element, which can lead to particulate accumulation in the separating device and to environmental pollution.

SUMMARY OF THE INVENTION

It is therefore an object of the present invention to provide a method and device for separating parcels, by means of which the prior art problems are reduced, notably with regard to the double-draw errors and clearance gap control.

This object is attained in accordance with the invention wherein flat parcels are separated from a stack of parcels by moving a drawing element in a conveying direction so that a first surface of the drawing element comes into contact with a first, i.e., front parcel of the stacked parcels. A stacking pressure is generating with a stack support element in a direction toward the first surface of the drawing element so that a force is exerted on the top parcel in the direction of the drawing element and the first surface of the drawing element is in close frictional contact with the top parcel. The force exerted on the top parcel in the direction of the first surface of the drawing element is increased by generating a vacuum on a side of the drawing element. The top parcel is conveyed with the drawing element through a gap between the drawing element and a guide wall provided for front edges of the stacked parcels.

Further advantageous features of the invention will become apparent from the detailed description of the preferred embodiments. For example, a reduction in paper abrasion and a simplification of the adjustment of separating devices are advantageously achieved with the invention. Moreover, a greater independence is achieved from the front edge alignment in the parcel stack, from the respective moisture content of the ambient air, and from the parcel material, and from parcel features such as the weight, thickness and roughness of the paper.

Because the pressing force between the first parcel in the stack and the drawing element is increased in accordance with the invention by means of a vacuum generated on the side of the drawing element, it is possible to reduce the stack pressure in comparison to the technique of friction-induced separation, which is known from the prior art. This absolutely or relatively increases the frictional dragging force on the first parcel in the stack, and the frictional force between the first parcel in the stack and the second parcel is absolutely or relatively reduced.

BRIEF DESCRIPTION OF THE DRAWINGS

The above and other features and advantages of embodiments of the invention will become apparent from the following detailed description taken with the drawings in which.

DETAILED DESCRIPTION OF THE PREFERRED EMBODIMENTS

The invention will now be described in more detail by example with reference to the embodiments shown in the Figures. It should be kept in mind that the following described embodiments are only presented by way of example and should not be construed as limiting the inventive concept to any particular physical configuration.

Figure 1A:
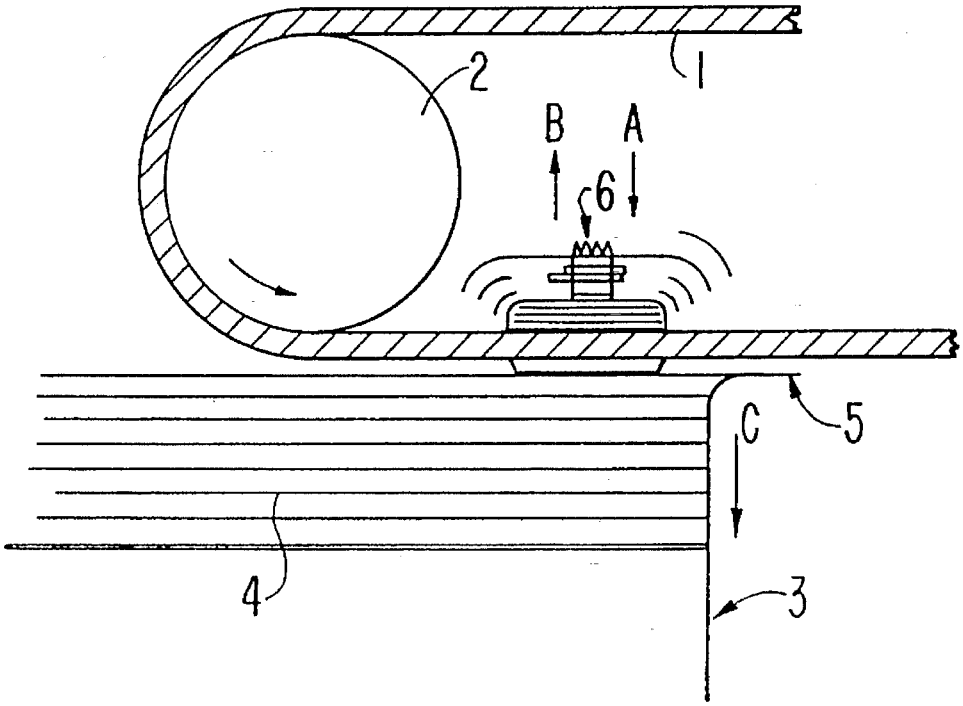
FIGS. 1A and B show an elevational view of and a plan view, respectively, of a separating device according to the invention.
Figure 1B:
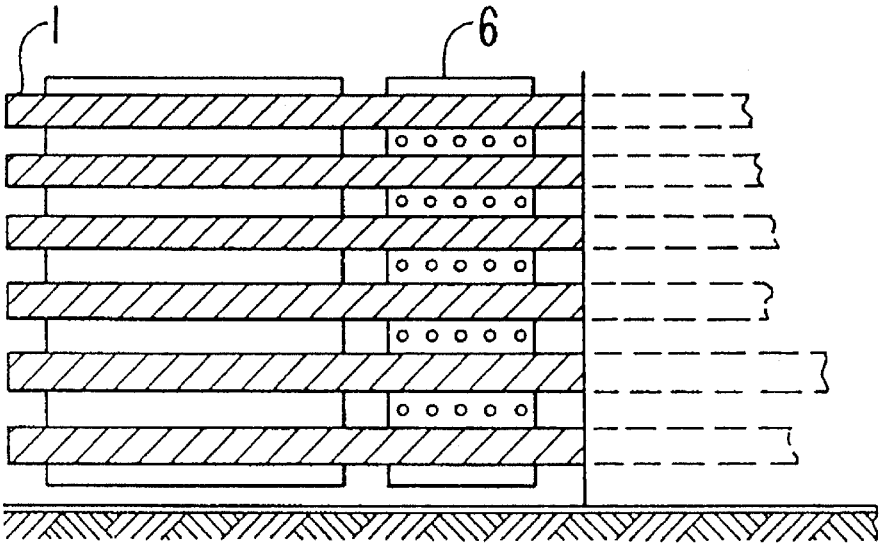

FIGS. 1A and 1B shows an embodiment of a device according to the invention. This embodiment includes a drawing element including, for example, a plurality of drawing belts 1 extending parallel and guided via a roller 2. A guide wall 3 is provided for the front edges of stacked parcels 4 which are to be conveyed through a passage opening 5 formed by the guide wall 3 and the drawing element (belts 1). In addition, an aspiration element 6 is provided disposed on the side of the drawing element. A vacuum is generated by aspiration element 6 on the side of the drawing element by means of which the pressing (frictional) force between the first (front) parcel in stack 4 and the drawing element belts 1 is increased.

The drawing belts 1 are coated with a material that has a high coefficient of friction. A deflection roller (not shown) may be disposed adjacent to the letter stack 4 and is advantageously seated on a rocker. Mechanical strippers (not shown) are preferably disposed in the region of the passage gap 5 and engage (grasp) between the drawing belts 1, that is, they do not come into contact with the drawing belts 1, thereby preventing wear, As can be better seen in the FIG. 1B, in the region of spaces between the drawing belts 1, the aspiration element 6 has a number of holes in its parcel-side surface, through which air is aspirated and the vacuum is thus generated. This vacuum causes the increase in the pressing force between the drawing belts 1 and a first (front) parcel in the parcel stack 4 to be drawn off described earlier.

Figure 2:
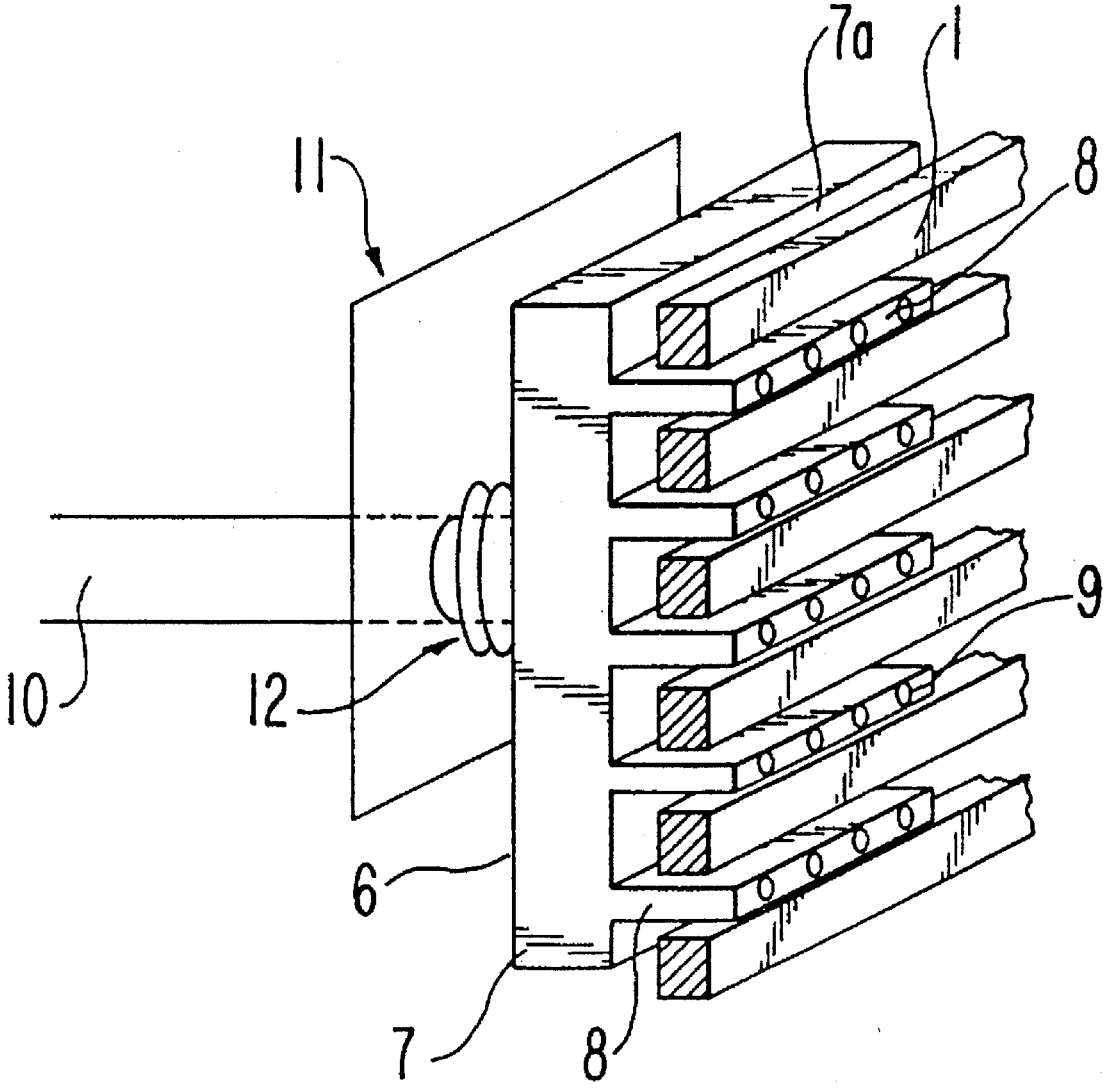
FIG. 2 shows a representation of an aspiration element for use in a method or device according to the invention.

FIG. 2 shows one advantageous embodiment of aspiration element 6. The aspiration element 6 in this embodiment has aspiration chambers 7 in which a vacuum is generated, and ledges 8 on whose parcel-side surface vacuum openings 9 are disposed. The aspiration chambers 7 are connected to an aspiration pipe 10 that is guided through a counterplate 11. An adjustable pressure spring 12 is disposed between the counterplate 11 and aspiration element 6. Drawing belts 1 pass between the ledges 8 at a predetermined distance from the surface *7a* of the aspiration chambers 7. The surfaces of the aspiration element 6 are polished on the parcel side and in regions in which contact with the drawing belts is possible.

Drawn-off parcels may be conveyed through the outlet of the drawing device through passage opening 5 to the inlet of a conveying device (not shown), for example. Light detectors (not shown) which are blocked by the passing parcels may be located in the region between the outlet of the drawing device shown in FIG. 1A and the inlet of the conveying device. The light detectors output signals which may be supplied to a control circuit (not shown) by means of which the drawing belts 1 can be started and stopped such that a predetermined clearance gap results between parcels during drawing. That is, the invention is preferably and advantageously operated in a stop-and-go fashion.

Aspiration element 6 should preferably be located close as possible to the plane of the guide wall 3, as shown in FIG. 1A. In this way, because of the generated vacuum, while leaving or before leaving the region of the vacuum, the respective first parcel in the stack 4 is securely grasped at its front surface by the drawing belts 1. However, following parcels are held more securely in the stack 4 as a consequence of the vacuum when the drawing belts 1 are not moving.

On the other hand, a specific minimum distance between the vacuum region and the guide plane 3 is provided, so that in parcel stacks that are not aligned precisely at the front edge, a possibly projecting further parcel is not held more strongly by the vacuum than the front parcel to be drawn off of the stack 4.

The width of the aspiration element 6 is adapted to the width of the drawing belts 1 disposed parallel therewith. This permits simple retrofitting of width separators which may already be present.

The vacuum to be used in accordance with the invention should not be too strong in order to assure gentle handling of the parcels and reduce paper abrasion. Therefore, the vacuum can preferably be generated with a Venturi tube, or the like. With regard to gentle handling of parcels and the avoidance of additional noise production, it is advantageous to keep the quantity of air flow, i.e., the air throughput, as large as possible, but to keep the vacuum as small as possible. The vacuum can be maintained permanently, or switched in coordination with control of the drawing element.

In a preferred embodiment of the invention, the aspiration element 6 vibrates (as indicated by the vibration marks in FIG. 1A) in the stack direction, or in a circular fashion in the stacking and drawing direction, with a frequency selected to be as low as possible below the auditory range. Because this vibration of the aspiration element 6 propagates around the surface of the friction belts 1, the first (front) letter in the parcel stack 4 is drawn toward the drawing belts 1, while the following parcels in the stack 4 are loosened and separate from the respective first parcel, because of the weak coupling between the individual parcels.

In a further preferred embodiment, the parcel stack 4 is pushed away from the drawing belts 1 in direction C by means of a controlled eccentric or the like when the belts 1 are not moving, in that the aspiration element 6 is pressed in the direction of arrow A through between the drawing belts 1 against the parcel stack 4. With the start of the drawing belts 1, the surface of the aspiration element 6 is pulled back in the direction of arrow B, using for example, spring 12, essentially to the contact surface between the drawing element and the first (front) parcel in the stack 4. The front parcel in the stack 4 is thus drawn toward the drawing belts 1, even with low stack pressure, and separates from the other parcels in the stack 4.

In a further preferred embodiment of the invention, the surfaces of the drawing belts 1 are aligned with the parcel-side surfaces of the aspiration element 6 when a parcel is in front of them. In this instance the aspiration element 6 is embodied to be mobile. By means of an elastic force, the aspiration element 6 is pulled behind the surface of the drawing belts 1, so that the first parcel in the stack 4 is drawn toward the drawing element. The letter feed is thus supported during a movement of the drawing belts 1, whereas when the drawing belts 1 are not moving, a parcel is strongly restrained. Therefore, the first parcel in the stack 4 is fed in the transport direction by means of the moved drawing belts 1 and grasped by the conveying devices following in the conveying direction, while the stopped drawing belts 1 subsequently cooperate with the Vacuum to strongly restrain the next parcel (in sequence).

The elastic, restoring force can be exerted by a spring motion for example, as a result of spring 12 connected with the aspiration element 6, or be generated by means of a vacuum in the aspiration system, for example by the embodiment of the aspiration element ledges 8 as shaft-shaped pipes that contract in a vacuum. In this embodiment, a vacuum is only used when a parcel to be drawn is in front of the aspiration element 6. Without this parcel, the aspiration surfaces protrude beyond the drawing belt surfaces and come into mechanical contact with the parcel stack 4.

Figure 3A:
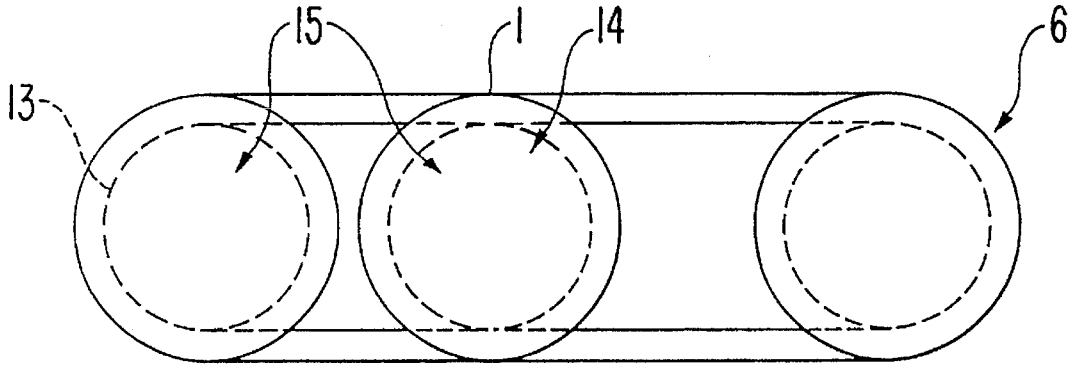
FIGS. 3A and 3B show an elevational view and a plan view, respectively, of an embodiment of the device according to the invention in which the aspiration element is configured as a cylindrical roller.
Figure 3B:
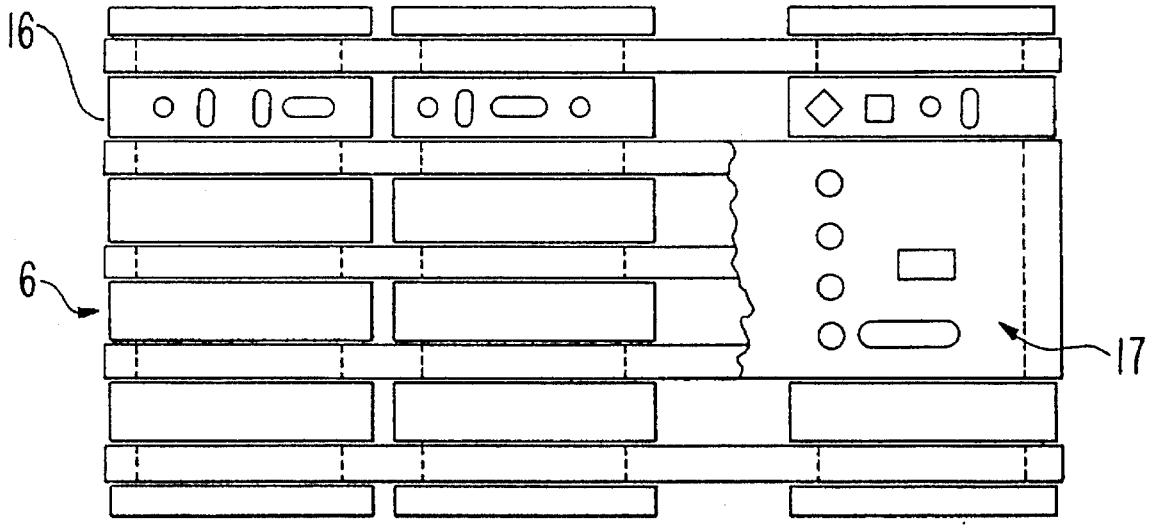

FIGS. 3A and 3B show further embodiments of the invention in which the aspiration elements (6) are configured as a perforated drum with a vacuum. As illustrated, rollers 13 and 14 are cylindrical. A vacuum is generated in the interior 15 of the cylinders by conventional means. The rollers 13 and 14 have vacuum apertures 16 in their cylinder casings in the parcel contact region.

Therefore, a vacuum is only generated in the region of the parcels, and not in the region that is in contact with the drawing belts 1. Consequently, the parcels to be drawn off are drawn toward the drawing belts 1 and are given an additional push (feed) in the conveying direction. Furthermore, with respect to the guide wall 3, what was described above with respect to the previous embodiment applies for the arrangement of the aspiration elements in this embodiment.

As a further embodiment, in combination with the previously described embodiments, the drawing belts can also be configured to have vacuum openings.

It will be understood that the above description of the preferred embodiment of the present invention is susceptible to various modifications, changes, and adaptations, and the same are intended to be comprehended within the meaning and range of equivalents of the appended claims.

What is claimed is:

1. A method for separating flat parcels from a stack of parcels, comprising:

operating a drawing element by moving, in a start-and-stop fashion, the drawing element in a conveying direction so that a surface of the drawing element comes into contact with a first parcel of the stacked parcels;

generating a stacking pressure with a stack support element in a direction toward the surface of the drawing element so that a force is exerted on the first parcel in the direction of the drawing element, and the surface of the drawing element is in frictional contact with the first parcel;

pressing a parcel-side surface of an aspiration element against the stack of parcels for moving the parcel stack away from the surface of the drawing element when the drawing element is not in motion;

retracting the aspiration element when the drawing element is in motion so that the parcel-side surface of the aspiration element is essentially in a plane of the surface of the drawing element which contacts the first parcel in the stack;

increasing the force exerted on the first parcel in the direction of the surface of the drawing element to increase the frictional contact between the surface of the drawing element and the first parcel by generating a vacuum on a side of the drawing element using the aspiration element; and conveying the first parcel with the drawing element through a passage gap defined between the drawing element and a guide wall provided for the stacked parcels.

2. The method as defined in claim 1, further comprising producing vibrations in one of a stacking direction or a conveying-and-stacking direction, which vibrations propagate across a region of the surface of the drawing element which is in contact with the first parcel of the stack.

3. A method as defined in claim 1, further comprising moving the aspiration element by elastic forces in a direction away from the parcel stack while the first parcel is being drawn off.

4. A method as defined in claim 1, wherein the step of increasing the force comprises generating the vacuum with a Venturi pipe.

5. A device for separating flat parcels from a stack, comprising:

a drawing element that travels in a conveying direction in a start-and-stop fashion, said drawing element having a surface acting by means of friction on a parcel to be drawn off;

a guide wall for the stacked parcels, the guide wall forming a gap with the drawing element for a drawn off parcel to pass through;

a support element for the stack, the support element generating a stack pressure in a direction of the drawing element;

an aspiration element for generating a vacuum to increase a pressing force between a first parcel in the stack and the drawing element so as to increase the frictional contact between the surface of said drawing element and the first parcel, the aspiration element being disposed on a side of the drawing element and having a surface facing the parcels;

means for pressing the surface of said aspiration element against the stacked parcels for moving the stacked parcels away from the surface of said drawing element when said drawing element is not in motion; and means for retracting the aspiration element when said drawing element is in motion so that the surface of said aspiration element is essentially in a plane of the surface of said drawing element.

6. The device as defined in claim 5, wherein the aspiration element comprises aspiration chambers with parcel-side opening surfaces that are one of aligned with or at a slight distance behind a contact surface of the drawing element and the first parcel.

7. The device as defined in claim 5, wherein the aspiration element is disposed a predetermined minimum distance from the guide wall.

8. The device as defined in claim 3, wherein the drawing element comprises at least one drawing belt circulating on traveling or driven rollers.

9. The device as defined in claim 8, wherein said aspiration element comprises rollers including cylindrical aspiration elements having vacuum openings in casings thereof in a parcel contact region.

10. The device as defined in claim 7, wherein the drawing element has vacuum openings therein.

* * * * *